United States Patent [19]

Rowley

[11] 4,341,421

[45] Jul. 27, 1982

[54] CHILD RESTRAINING ARTICLE

[75] Inventor: Kathryn E. Rowley, Rockledge, Pa.

[73] Assignee: Barbara J. Braun, Rockledge, Pa.

[21] Appl. No.: 166,136

[22] Filed: Jul. 7, 1980

[51] Int. Cl.[3] ..... A47D 13/08

[52] U.S. Cl. ..... 297/465; 297/486

[58] Field of Search ..... 297/465, 464, 466, 486; 280/801; 2/103, 70

[56] References Cited

U.S. PATENT DOCUMENTS

| | | | |
|---|---|---|---|
| 703,483 | 7/1902 | Schreck . | |
| 1,489,046 | 4/1924 | Thompson | 2/70 |
| 1,551,932 | 9/1925 | St. Carver . | |
| 2,184,404 | 12/1939 | Stricker | 297/465 |
| 2,414,698 | 1/1947 | Picard . | |
| 2,567,400 | 9/1951 | Rahe | 297/465 |
| 2,648,845 | 8/1953 | Berman | 2/70 X |
| 2,767,403 | 10/1956 | Givens | 297/465 X |
| 2,826,246 | 3/1958 | Adams et al. | 297/466 |
| 3,181,530 | 5/1965 | Stovey | 297/465 X |
| 3,992,040 | 11/1976 | Gannac | 297/465 |

FOREIGN PATENT DOCUMENTS

| | | | |
|---|---|---|---|
| 2227454 | 1/1974 | Fed. Rep. of Germany | 297/465 |
| 728849 | 4/1955 | United Kingdom | 297/465 |

*Primary Examiner*—James T. McCall

*Attorney, Agent, or Firm*—Raymond Underwood

[57] ABSTRACT

A child restraining article is made up of a sheet of material which has two holes in it to receive a child's legs and also has tie tabs at its edges to be tied to a chair frame. It may also include an integral or detachable sheet with arm holes and tie tabs to be tied to the chair. In addition a bib may be integral with or detachably connected to the portion with arm holes in it.

1 Claim, 5 Drawing Figures

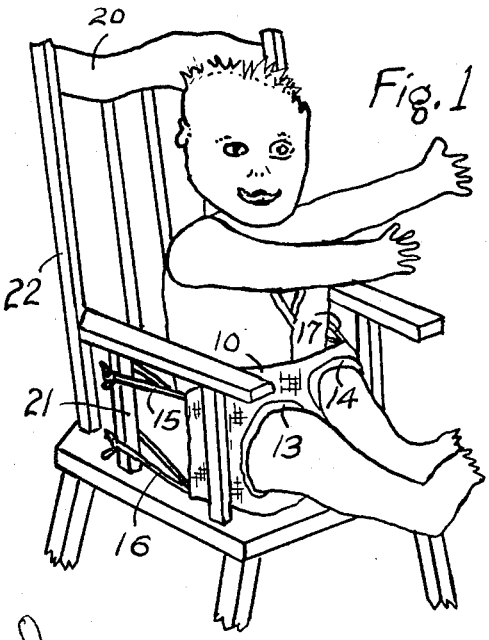
Fig. 1
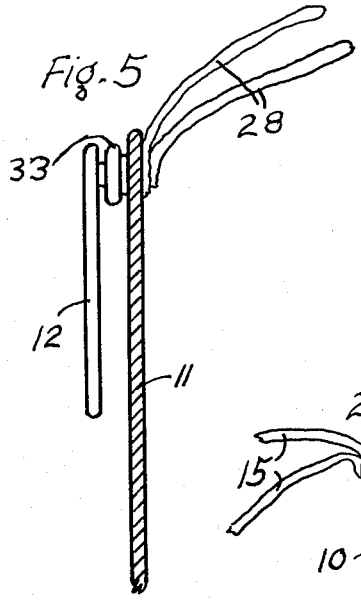
Fig. 5
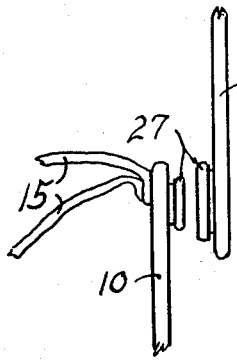
Fig. 3
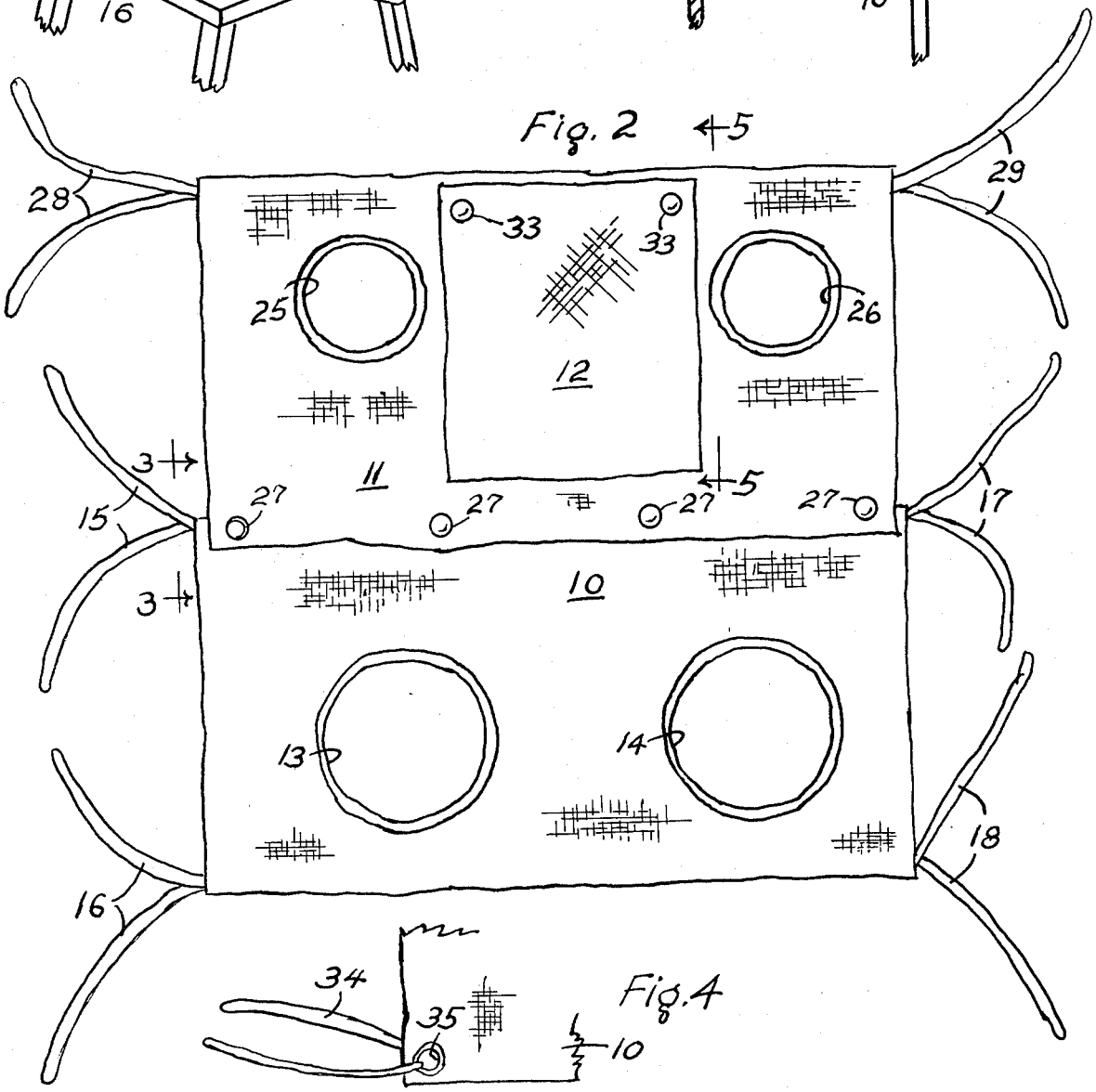
Fig. 2
Fig. 4

CHILD RESTRAINING ARTICLE

This invention relates to child restraining articles and particularly to an assembly which will keep a child or infant in a chair or like seating piece.

When a child is placed in a chair he often tends to slouch down in it or sraighten out. This has the tendency to advance the child forward and off the seat with the resultant possibility of falling to the floor and getting injured. This is especially likely to happen if the child is in an ill mood and does not want to remain in the chair.

Harnesses of various kinds have been proposed to resist the efforts of a child to advance himself forwardly and off the front edge of the seat. The simplest kind of harness is described and illustrated in U.S. Pat. No. 703,483 which issued to C. J. Schreck in 1902 as it shows a strap 10 which goes over the child's chest and a strap 12 which goes over the child's shoulder. The patent says it is a "safety harness" but an inspection of it shows that it does not prevent the child from moving forward and probably off of the chair seat.

This same failure to provide an adequate restraint to hold a child back on a chair or other seat is equally true of later U.S. Pat. No. 1,551,932 to Carver of 1928 and U.S. Pat. No. 1,651,451 to Storey of 1927. With them on the child and used in the intended manner the child can still move forward enough to run the serious risk of falling on the floor and getting hurt.

Some harnesses and high chairs have included a strap which goes between the child's legs and is close to his body. Such a strap is shown at 10 in the A. Picard U.S. Pat. No. 2,414,698 which issued in 1947. This has the serious drawback that the strap may or does bear against the child's privates and can cause an injury or an irritation. If the child is to be in the chair for a long time the annoyance caused by such a restraining strap can make the child very fussy.

The article of the present invention has the feature of more than adequately restraining the child back on the seat. It limits the child's forward movement without pressing against the child's genital area. It is very easy to make and consequently can be put together by the mother or can be purchased at a very low price.

The child restraining article can have a unitized structure or it can be an assembly of separate items. As will appear, it can be a simple piece which restrains the child below the waist, it can include a part which holds the child's chest from undue forward movement or it can include a bib portion if this is selected.

These and other features of the invention will appear from the following description when considered in conjunction with the accompanying drawings in which:

FIG. 1 is a perspective view showing a child restrained in a chair by an article of the invention, FIG. 2 is a face view of a composite article of the invention, FIG. 3 is a partial section on the line 3–3 of FIG. 2 to show how parts of the assembly can be held together, FIG. 4 shows a variation of the invention, and FIG. 5 is a partial section on the line 5–5 of FIG. 2.

A complete assembly of the restraining article is made up of the bottom or lower sheet 10, the upper or chest sheet 11 and the bib sheet 12. They are here shown as three separate pieces which are detachably connected together but the invention contemplates that they could be made of one sheet of material so that they form a unit. If they are made as three separate pieces which can be attached together to form an assembly unit, they can be used individually as will appear.

The bottom sheet 10 has the two leg holes 13 and 14 cut into it and to sustain wear and make a better appearance the edges of these holes may be hemmed or bound with binding tape as will be clearly understood by a person familiar with sewing. The holes 13 and 14 should be large enough to freely receive the upper part of the child's legs close to the body so that the legs will not be constricted.

The sheet 10 is preferably an elongated rectangle as is shown but the side or vertical edges could as well be rounded if it is thought that this would be more attractive, for instance. The leg openings 13 and 14 are disposed along the longer dimension of the sheet 10 and about midway of its height.

To each of the four corners of the sheet 10 are attached a pair of ties or tapes; these are respectively shown at 15, 16, 17 and 18. Practically any one of the commercially obtainable sewing tapes may be used but it is preferable to use the so called bias tape. Each pair of tapes may be attached to its corner of the sheet 10 by stitching.

FIG. 1 shows how the restraining article formed by sheet 10 and its attached tie tapes is used to hold a child in a chair 20. The sheet 10 is passed over the child's legs and somewhat close to its body and then each pair of ties 15, 16, 17 and 18 is attached to an appropriate post or rung of the chair. Each pair of tie tapes would be tied together as with the conventional bow-tie, and around a post such as 21.

From FIG. 1 it is evident that the child is effectively held back in the chair and that he cannot strain and wiggle himself to the front edge of the chair and possibly fall off of it. As the sheet 10 is made of thin, flexible material it does not bind the child or become uncomfortable. It does not bear against the child's genital area such as a strap does. The child is quite comfortable with it on him for a long period of time.

The sheet 10 can be ordinary cotton cloth or it can be of woven or knitted plastic thread such as Nylon or Dacron. Or it can be made of nonwoven plastic sheeting or film such as vinyl or polyester material which is commercially obtainable. Such plastics or rubberized cotton sheets have the advantage of being waterproof. The tie tapes can be selected from these materials and if desired thay may be the ordinary elastic tapes.

The sheet 10 can be used alone as is shown in FIG. 1 or the top sheet 11 can be attached to it. This top sheet is elongated and along its length are the two arm holes 25 and 26 which are located about midway of the height of the rectangle or slightly toward the top edge. These arm holes may be smaller than the leg holes 13 and 14 and like them are preferably reinforced as by hemming.

The lower end of sheet 11 may be detachably fastened to the top edge of sheet 10 by any suitable means such as the snap buttons 27 shown in FIGS. 2 and 3. Or, this temporary attachment may be by the ordinary zipper or hooks and eyes. At each upper corner is attached the pair of tie tapes 28 and 29 respectively to be tied to the chair such as the post 22. The sheet 11 would be made out of any of the materials mentioned above.

The addition of the top sheet 11 provides a further means for restraining the child in a chair. Because of its flexible and yieldable construction it is not uncomfortable and does not irritate a child such as a narrow strap does. It is to be clearly understood that the sheet units 10 and 11 may in fact be one sheet of material so that the attachment at 27 is eliminated.

Another feature of the invention is the provision of the bib portion 12 which is particularly useful if the upper sheet 11 is not waterproof; the bib should be made of waterproof material. Its width is the same as conventional bibs which vary in size. Ordinarily the top edges of the chest sheet 11 and of the bib 12 will be straight and will lie fairly straight across the child's neck but if it is thought to be desirable these edges may be formed with notches of the kind which is usually present in the conventional bib.

The bib portion 12 is shown as temporarily attached to the sheet 11 by means of conventional snap buttons shown at 33. Or, a conventional zipper or hooks and eyes may be used or other removable attachment arrangements may be provided. These alternate attachment means may replace the snap buttons at 27. Also, as is mentioned above, the bib portion 12 may be an integral part of the sheet 11 instead of the separable part shown.

Other variations of the structure may be made such as to attach the tie bands or tapes to the sheets with snap buttons. Or, as shown in FIG. 4 small holes 35 may be made in the corners of the sheets so that a long tape 34 can be passed through them. Preferably, such holes 35 would be reinforced. The top edge of the sheet 10 is preferably about at the waist of the child but it may lie somewhat higher or lower.

I claim:

1. A composite child restraining assembly which comprises three attached but separable sheets, namely:

an elongated lower sheet which has along its length two spaced holes in it to receive a child's legs close to its body and has attached to it at each of its four corners tapes to be used to tie the lower sheet to a chair frame, an elongated chest sheet having two arm holes in it along its length and also tapes at its two top edge corners to tie to a chair frame, a separable attachment between the lower sheet and the chest sheet along their meeting edges, a waterproof bib sheet overlying the top central portion of the chest sheet between the arm holes, and a separable attachment between the top edges of the bib sheet and the chest sheet.

* * * * *